US012433462B2

(12) United States Patent
Liang et al.

(10) Patent No.: US 12,433,462 B2
(45) Date of Patent: Oct. 7, 2025

(54) CLEANING ROBOT AND ROBOT SYSTEM

(71) Applicant: SHENZHEN SILVER STAR INTELLIGENT GROUP CO., LTD., Shenzhen (CN)

(72) Inventors: Xue Liang, Shenzhen (CN); Yi Hu, Shenzhen (CN); Xuehua Li, Shenzhen (CN)

(73) Assignee: SHENZHEN SILVER STAR INTELLIGENT GROUP CO., LTD., Shenzhen (CN)

( * ) Notice: Subject to any disclaimer, the term of this patent is extended or adjusted under 35 U.S.C. 154(b) by 299 days.

(21) Appl. No.: 17/900,547

(22) Filed: Aug. 31, 2022

(65) Prior Publication Data

US 2023/0165421 A1 Jun. 1, 2023

(30) Foreign Application Priority Data

Nov. 30, 2021 (CN) ..... 202111445673.4

(51) Int. Cl.
*A47L 9/14* (2006.01)
*A47L 9/00* (2006.01)
(Continued)

(52) U.S. Cl.
CPC ..... *A47L 9/149* (2013.01); *A47L 9/0063* (2013.01); *A47L 9/1409* (2013.01); *A47L 11/28* (2013.01);
(Continued)

(58) Field of Classification Search
CPC ..... A47L 2201/00; A47L 2201/024; A47L 2201/026; A47L 11/4025; A47L 11/4083;
(Continued)

(56) References Cited

U.S. PATENT DOCUMENTS

2012/0291809 A1* 11/2012 Kuhe ..... A47L 11/33 134/18
2020/0367714 A1* 11/2020 Wang ..... A47L 11/4083

FOREIGN PATENT DOCUMENTS

CN 109222760 A * 1/2019 ..... A47L 11/24
CN 212591919 U * 2/2021
(Continued)

OTHER PUBLICATIONS

Translation of CN 113303721 A (Year: 2021).*
(Continued)

*Primary Examiner* — David S Posigian
*Assistant Examiner* — Steven Huang
(74) *Attorney, Agent, or Firm* — Zhigang Ma

(57) ABSTRACT

Provided are cleaning robot and robot system, the cleaning robot includes robot main body and cleaning box assembly, the robot main body is provided with debris inlet channel, the cleaning box assembly is detachably mounted at one side of robot main body, and includes debris storage box and liquid storage box detachably connected thereto, the debris inlet channel, the debris storage box, and the liquid storage box are sequentially arranged in advancing direction of robot main body, the debris storage box is provided with air inlet and debris collection cavity, the air inlet is butted with the debris inlet channel, the debris collection cavity communicates with the debris inlet channel via the air inlet, the liquid storage box is provided with debris discharge port, the debris discharge port pneumatically communicates with the debris collection cavity, and the debris discharge port discharges debris in it with vacuum negative pressure.

12 Claims, 12 Drawing Sheets

(51) Int. Cl.
*A47L 11/28* (2006.01)
*A47L 11/40* (2006.01)

(52) U.S. Cl.
CPC ..... *A47L 11/4025* (2013.01); *A47L 11/4083* (2013.01); *A47L 11/4088* (2013.01); *A47L 11/4091* (2013.01); *A47L 2201/024* (2013.01)

(58) Field of Classification Search
CPC .. A47L 11/4088; A47L 11/4094; A47L 11/20; A47L 11/201; A47L 11/30; A47L 11/302; A47L 11/305; A47L 11/307; A47L 11/40; A47L 9/149; A47L 9/0063; A47L 9/1409; A47L 9/1463; A47L 7/0023; A47L 7/0038; A47L 7/0061
USPC ..... 15/319, 320
See application file for complete search history.

(56) References Cited

FOREIGN PATENT DOCUMENTS

| | | | | |
|---|---|---|---|---|
| CN | 212879151 | U | * | 4/2021 |
| CN | 213309479 | U | * | 6/2021 |
| CN | 113303721 | A | * | 8/2021 |
| TW | M555703 | U | * | 2/2018 |

OTHER PUBLICATIONS

Translation of CN 212591919 U (Year: 2021).*
Translation of CN 109222760 A (Year: 2019).*
Translation of CN 212879151 U (Year: 2021).*
Translation of CN 213309479 U (Year: 2021).*
Translation of TW M555703 U (Year: 2018).*

* cited by examiner

CLEANING ROBOT AND ROBOT SYSTEM

CROSS-REFERENCE TO RELATED APPLICATIONS

The present application claims priority to Chinese patent application with the application number 2021114456734 filed to the China Patent Office on Nov. 30, 2021, entitled "Cleaning Robot and Robot System", the entire contents of which are incorporated herein by reference.

TECHNICAL FIELD

The present disclosure relates to the technical field of cleaning robots, and more particularly, to a cleaning robot and a robot system.

BACKGROUND ART

The cleaning robot is used for sweeping, vacuuming, or mopping a surface to be cleaned with cleaning elements thereon while moving on the surface to be cleaned.

The cleaning robot is designed for use in a single scenario by carrying a single-function cleaning box. The cleaning box may be a debris storage box or a liquid storage box. For example, in a debris collection and debris discharge scenario, a user hangs the debris storage box on a main body of the cleaning robot, and the cleaning robot can collect debris into the debris storage box and discharge the collected debris through a debris discharge port of the debris storage box after collecting enough debris; alternatively, in a mopping scenario, the user hangs the liquid storage box on the main body of the cleaning robot, and the cleaning robot can provide a cleaning solution for a mopping and wiping assembly through the liquid storage box so as to perform a wet mopping operation. As the function of the cleaning box is relatively single, the user needs to manually switch different types of cleaning boxes frequently to adapt to different use scenarios, which affects the user experience.

SUMMARY

An objective of embodiments of the present disclosure is to provide a cleaning robot, so as to solve the technical problem that the function of the existing cleaning boxes is relatively single, and the user needs to manually switch different types of cleaning boxes frequently to adapt to different use scenarios.

In order to achieve the above objective, the present disclosure adopts the following technical solution.

An embodiment of the present disclosure provides a cleaning robot, the cleaning robot includes a robot main body and a cleaning box assembly, the robot main body is provided with a debris inlet channel, the cleaning box assembly is detachably mounted at one side of the robot main body, the cleaning box assembly includes a debris storage box and a liquid storage box detachably connected to the debris storage box, the debris inlet channel, the debris storage box, and the liquid storage box are sequentially arranged in an advancing direction of the robot main body, the debris storage box is provided with an air inlet and a debris collection cavity, the air inlet is provided to be butted with the debris inlet channel, the debris collection cavity is provided to be in communication with the debris inlet channel via the air inlet, the liquid storage box is provided with a debris discharge port, the debris discharge port is provided to be in pneumatic communication with the debris collection cavity, and the debris discharge port is configured to evacuate debris in the debris collection cavity under vacuum negative pressure.

The cleaning robot provided in the present disclosure has the following beneficial effects:

compared with the prior art, regarding the cleaning robot and the robot system provided in the present disclosure, as the cleaning box assembly is detachably mounted at one side of the robot main body, the cleaning box assembly includes the debris storage box and the liquid storage box detachably connected to the debris storage box, the debris inlet channel, the debris storage box, and the liquid storage box are sequentially arranged in the advancing direction of the robot main body, the debris storage box and the liquid storage box are provided at the same side of the cleaning robot in a hanging manner, and it is convenient for the cleaning robot to further realize the functions of vacuuming (debris suction) and water supply mopping. Further, the liquid storage box is provided with the debris discharge port, the debris discharge port is provided to be in pneumatic communication with the debris collection cavity, the debris discharge port is configured to discharge the debris in the debris collection cavity under vacuum negative pressure, so that a combination of the liquid storage box and the debris storage box has multiple functions such as debris collecting, debris discharging, and liquid storing, and the user can realize use of the cleaning robot in multiple scenarios (debris collection and debris discharging scenario, a mopping scenario, etc.), without frequently switching between a debris collecting module and a liquid storing module.

BRIEF DESCRIPTION OF DRAWINGS

In order to more clearly illustrate technical solutions in the embodiments of the present disclosure, accompanying drawings which need to be used in the embodiments or the prior art will be introduced briefly below. Apparently, the accompanying drawings in the descriptions below merely show some embodiments of the present disclosure, and those ordinarily skilled in the art still could obtain other accompanying drawings in light of these accompanying drawings, without using creative efforts.

DETAILED DESCRIPTION OF EMBODIMENTS

In order to make the technical problems to be solved by the present disclosure, the technical solutions, and the beneficial effects clearer, the present disclosure is further described in detail below with reference to the accompanying drawings and the embodiments. It should be understood that the embodiments described herein are merely used to explain the present disclosure, rather than being intended to limit the present disclosure.

Figure 1:
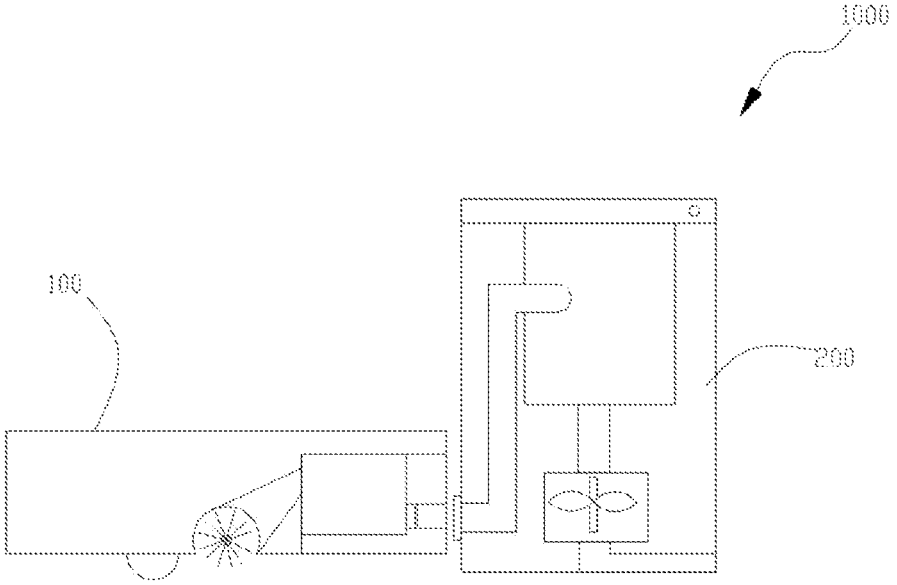
FIG. 1 is a structural schematic view of a robot system provided in an embodiment of the present disclosure.
Figure 2:
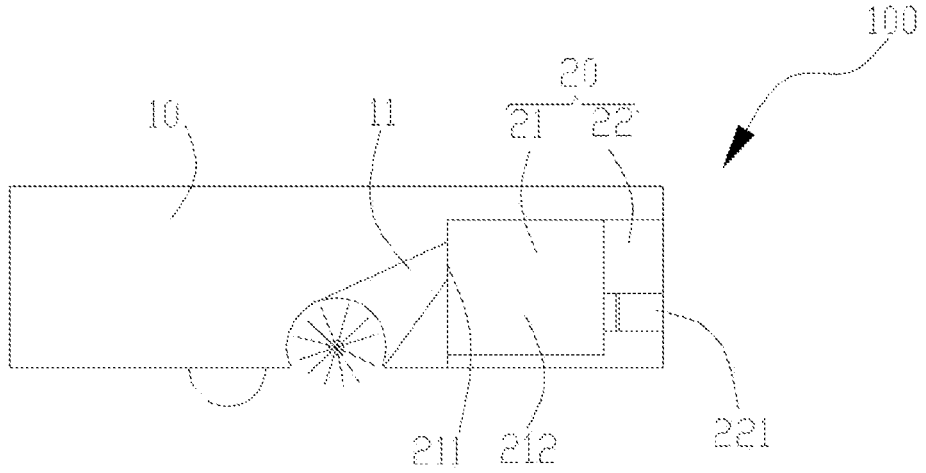
FIG. 2 is a structural schematic view of a cleaning robot provided in an embodiment of the present disclosure.
Figure 3:
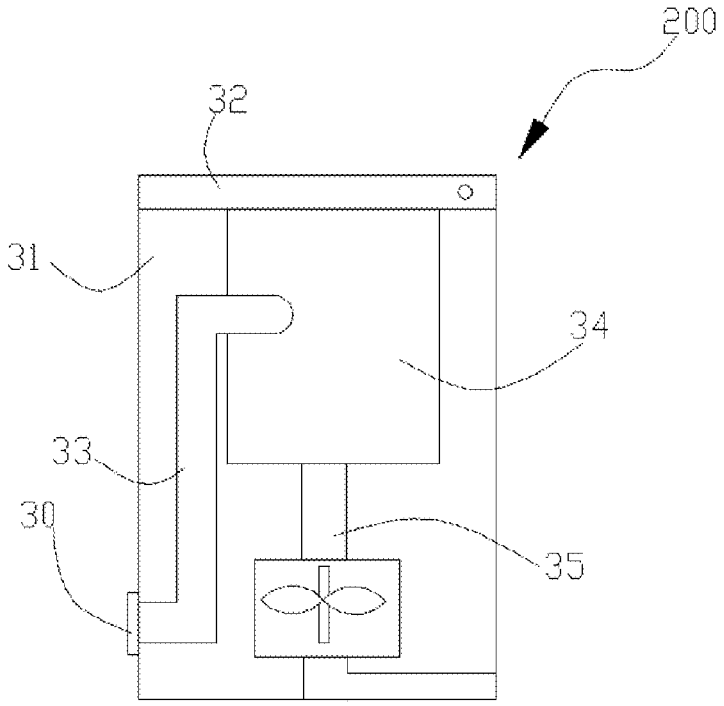
FIG. 3 is a structural schematic view of a debris collection base station provided in an embodiment of the present disclosure.

Referring to FIG. 1 to FIG. 3, an embodiment of the present disclosure provides a robot system 1000, wherein the robot system 1000 includes a cleaning robot 100 and a debris collection base station 200.

The cleaning robot 100 includes a robot main body 10 and a cleaning box assembly 20. The robot main body 10 is provided with a debris inlet channel 11. The cleaning box assembly 20 is detachably mounted at one side of the robot main body 10. The cleaning box assembly 20 includes a debris storage box 21 and a liquid storage box 22 detachably connected to the debris storage box 21. The debris inlet channel 11, the debris storage box 21, and the liquid storage box 22 are sequentially arranged in an advancing direction of the robot main body 10. The debris storage box 21 is provided with an air inlet 211 and a debris collection cavity 212, wherein the air inlet 211 is provided to be butted with the debris inlet channel 11, and the debris collection cavity 212 is provided to be in communication with the debris inlet channel 11 via the air inlet 211. The liquid storage box 22 is provided with a debris discharge port 221, wherein the debris discharge port 221 is provided to be in pneumatic communication with the debris collection cavity 212, and the debris discharge port 221 is configured for evacuating debris in the debris collection cavity 212 under vacuum negative pressure.

Without no doubt, the debris storage box 21 and the liquid storage box 22 also can be installed on the robot separately and independently without being assembled together.

The debris collection base station 200 is provided with a debris collection port 30, and the debris discharge port 221 of the cleaning robot 100 is configured to be aligned with the debris collection port 30 so as to allow the debris collection base station 200 to collect the debris from the debris collection cavity 212 under vacuum negative pressure.

Compared with the prior art, regarding the cleaning robot 100 and the robot system 1000 provided in the present disclosure, as the cleaning box assembly 20 is detachably mounted at one side of the robot main body 10, the cleaning box assembly 20 includes the debris storage box 21 and the liquid storage box 22 detachably connected to the debris storage box 21, the debris inlet channel 11, the debris storage box 21, and the liquid storage box 22 are sequentially arranged in the advancing direction of the robot main body 10, the debris storage box 21 and the liquid storage box 22 are provided at the same side of the cleaning robot 100 in a hanging manner, and it is convenient for the cleaning robot 100 to further realize the functions of vacuuming (debris suction) and water supply mopping. Further, the liquid storage box 22 is provided with the debris discharge port 221, the debris discharge port 221 is provided to be in pneumatic communication with the debris collection cavity 212, the debris discharge port 221 is configured to discharge the debris in the debris collection cavity 212 under vacuum negative pressure, so that a combination of the liquid storage box 22 and the debris storage box 21 has multiple functions such as debris collecting, debris discharging, and liquid storing, and the user can realize use of the cleaning robot 100 in multiple scenarios (a debris collecting scenario, a debris discharging scenario, a mopping scenario, etc.), without frequently switching between a debris collecting module and a liquid storing module.

In the present embodiment, the debris collection base station 200 includes a base station main body 31 and a cover body 32. The base station main body 31 is a main body part of the debris collection base station 200, and the base station main body 31 is provided with a debris collection port 30, a debris intake channel 33, an inner cavity 34, and an air exhaust channel 35. The debris collection port 30 is provided outside the base station main body 31, and the debris collection port 30 is configured to be aligned with the debris discharge port 221 of the cleaning robot 100. The inner cavity 34 is configured to accommodate a debris collection assembly, the inner cavity 34 has an open end, and the debris collection assembly is detachably mounted in the inner cavity 34 of the base station main body 31 via the open end. The cover body 32 is rotatably connected to the base station main body 31, so as to close or open the open end of the inner cavity 34. The debris intake channel 33 has one end being in communication with the debris collection port 30, and the other end being in communication with the inner cavity 34. The air exhaust channel 35 has one end being in communication with the debris collection cavity 212, and the other end being in communication with the atmosphere. The debris collection assembly is mounted in the inner cavity 34 and may be in communication with the debris intake channel 33, and be in communication with the air exhaust channel 35. A debris-exhaust fan is located in the air exhaust channel 35. The debris-exhaust fan is configured to drive gas to flow. The debris-exhaust fan can drive the gas in the inner cavity 34 to flow towards the air exhaust channel 35 so as to be discharged to the outside, thus negative pressure is generated in the debris collection assembly and the debris intake channel 33, then the debris in the cleaning robot 100 is sucked into the debris collection assembly under the negative pressure, thus, a debris collection action is achieved.

It can be understood that, the cleaning robot 100 can autonomously navigate to the debris collection base station 200, such that the cleaning robot 100 completes docking with the debris collection base station 200, the debris discharge port 221 of the cleaning robot 100 is in butt-communication with the debris collection port 30 of the debris collection base station 200, such that the debris collection base station 200 can suck the debris in the cleaning robot 100 via the above debris collection port 30 and the debris discharge port 221, realizing the collection action of the debris from the cleaning robot 100 to the debris collection base 200.

It can be understood that, the cleaning robot 100 may be any one of a floor mopping robot, a sweeping and mopping integrated robot, a driving-type cleaning robot, a hand-held cleaning robot, or a mopping robot.

The robot main body 10 may include a chassis and an upper cover assembly, wherein the upper cover assembly is detachably mounted on the chassis, so as to protect various functional assemblys inside the cleaning robot 100 against violent collision or damage by an inadvertently spilled liquid during use; and the chassis and/or the upper cover assembly is configured to carry and support the various functional assemblys. A surface of the upper cover assembly facing away from the chassis forms an appearance surface, so that the overall appearance of the cleaning robot 100 can be improved, and a button may be provided on the appearance surface, so that it is convenient for the user to operate the cleaning robot 100 through the button. A mounting cavity is formed between the chassis and the upper cover assembly, and the mounting cavity is configured to provide an arrangement space for devices inside the cleaning robot 100. A vacuum pump, a circuit board, a ground detection sensor, a collision detection sensor, a wall following sensor, etc. can be arranged in the mounting cavity of the cleaning robot 100.

The cleaning robot 100 includes a traveling mechanism mounted on the chassis, wherein the traveling mechanism includes two traveling wheels and at least one universal wheel, and the two traveling wheels and the at least one universal wheel at least partially protrude from the bottom of the chassis. For example, the two traveling wheels may be partially hidden in the chassis under the action of the weight of the cleaning robot 100 itself. In an optional embodiment, the traveling mechanism further may include any one of a triangular crawler wheel, a Mecanum wheel, and the like. It is also feasible that the traveling mechanism does not include the at least one universal wheel.

The cleaning robot 100 may include at least one middle sweeping brush, and the at least one middle sweeping brush may be provided in an accommodating groove provided at the bottom of the chassis. The accommodating groove is provided therein with a debris suction port, and the debris suction port is in communication with the debris storage box 21 and a debris suction fan, so that debris on the ground are stirred up when the middle sweeping brush is rotated, and a suction force is generated by the debris suction fan to suck the debris from the debris suction port into the debris storage box 21. The debris inlet channel 11 is provided between the debris suction port and the air inlet 211, and the debris inlet channel 11 has one end being in communication with the debris suction port, and the other end being in communication with the air inlet 211 of the debris storage box 21. The debris lifted up by the middle sweeping brush can enter the debris storage box 21 via the debris inlet channel 11 under the suction effect of the debris suction fan. In other embodiments, the debris inlet channel 11 may be formed by at least a part of the accommodating groove and the debris suction port.

The cleaning robot 100 can be designed to autonomously plan a path on the ground, and also can be designed to move on the ground in response to a remote control instruction. The cleaning robot 100 may navigate by using one or a combination of more than one of a gyroscope, an accelerometer, a camera, GPS positioning and/or laser radar, etc., for example, the cleaning robot 100 may be provided on a top surface with a laser radar in a protruding way, and scans the surrounding environment by the laser radar to collect obstacle data, establish an environment map according to the obstacle data, and can perform real-time positioning according to the environment map, so as to facilitate planning of a cleaning path.

Figure 4:
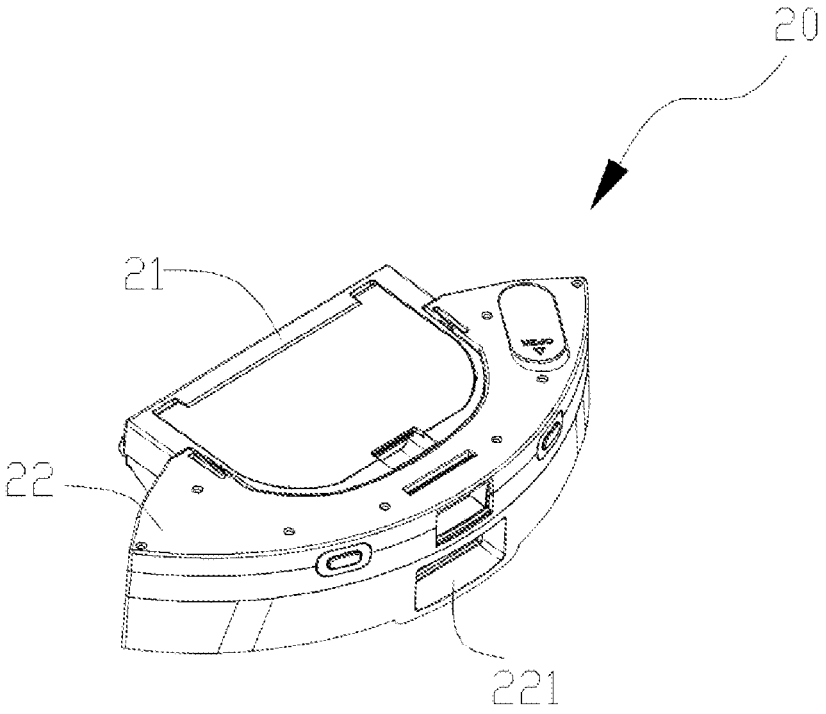
FIG. 4 is a first structural schematic view of a cleaning box assembly provided in an embodiment of the present disclosure.
Figure 5:
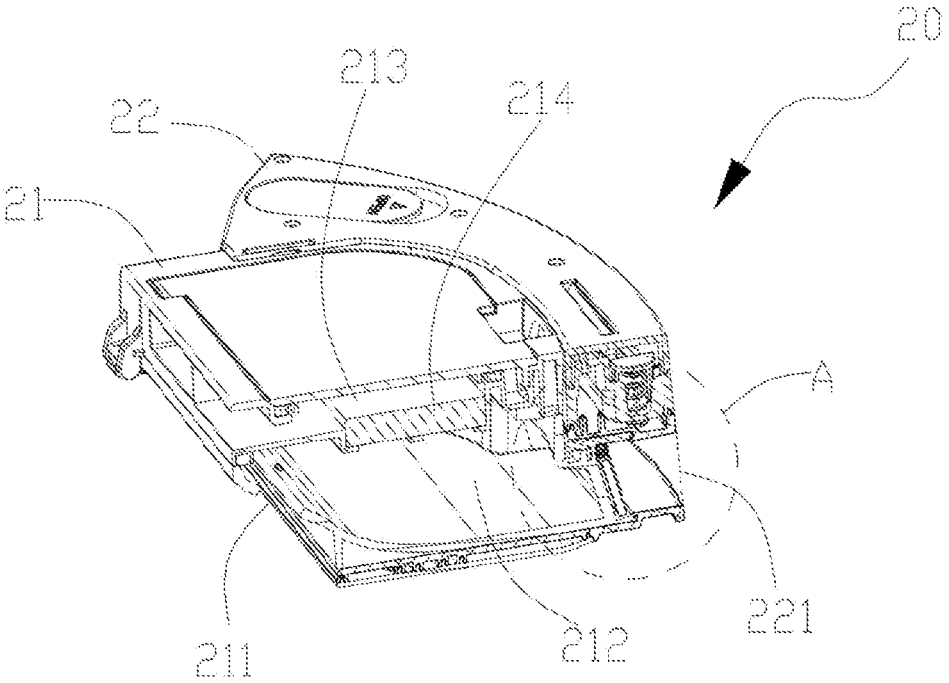
FIG. 5 is a first sectional structural schematic view of the cleaning box assembly provided in an embodiment of the present disclosure.
Figure 6:
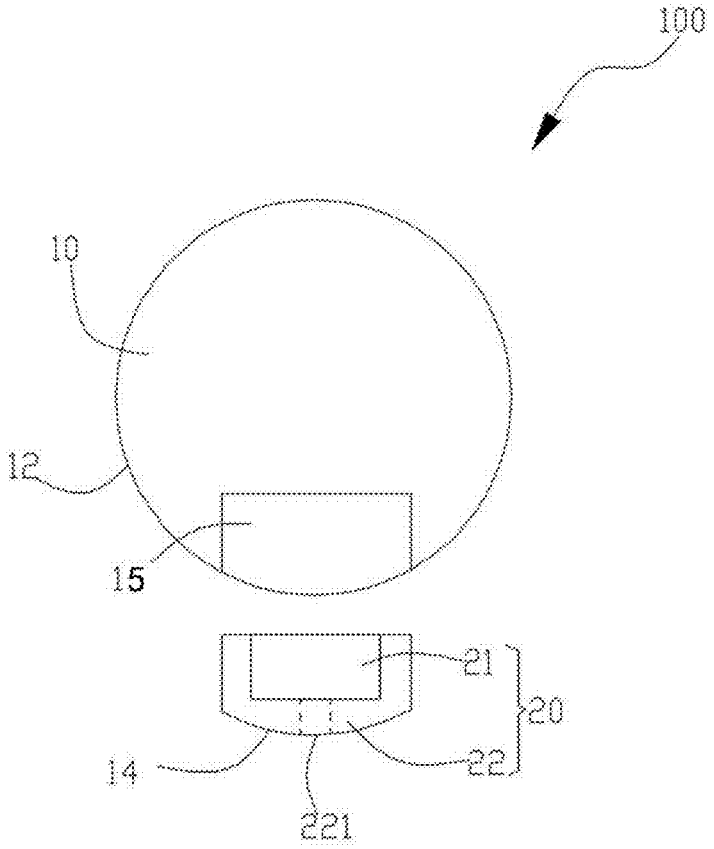
FIG. 6 is an exploded schematic view of the cleaning robot provided in an embodiment of the present disclosure (a robot main body is separated from the cleaning box assembly)

With continued reference to FIG. 4 to FIG. 6, in the present embodiment, the debris storage box 21 is provided with an air exhaust channel 213 in communication with the debris collection cavity 212, and a filtering structure 214 mounted in the air exhaust channel 213. The debris suction fan of the cleaning robot 100 is in butt-communication with the air exhaust channel 213 through an air duct. The filtering structure 214 is configured to filter debris carried in the airflow so as to retain the debris carried in the airflow in the debris collection cavity 212.

The liquid storage box 22 is provided with a liquid storage cavity, and the liquid storage cavity is configured to store any one of water, a cleaning solution or a mixture of water and the cleaning solution, etc. The liquid storage box 22 can supply a liquid to the mopping and wiping assembly through a pipeline under the driving effect of an air pump or a water pump, so as to sufficient wet the mopping and wiping assembly, and further the cleaning robot 100 can operate on a surface to be cleaned through the mopping and wiping assembly.

With continued reference to FIG. 4 to FIG. 6, the debris storage box 21 is detachably connected to the liquid storage box 22, the debris storage box 21 and the liquid storage box 22 are assembled to form a whole, and an assembly constituted by the debris storage box 21 and the liquid storage box 22 is detachably connected to the robot main body 10. The user can operate the assembly constituted by the debris storage box 21 and the liquid storage box 22, and can detach the assembly from the robot main body 10. Further, the user can continue to detach and separate the debris storage box 21 from the liquid storage box 22.

In the above, the robot main body 10 has a first circumferential side surface 12 and a robot main body mounting groove 15 penetrating through the first circumferential side surface 12. The debris storage box 21 and the liquid storage box 22 are detachably mounted in the robot main body mounting groove 15. The liquid storage box 22 has a second circumferential side surface 14, and the second circumferential side surface 14 is flush with the first circumferential side surface 12 to form a continuous ring shape. The debris discharge port 221 is provided in a way of penetrating through the second circumferential side surface 14. In the above, the ring shape may be a circular ring, a rectangular ring, or other shaped rings, etc., which could be set by those skilled in the art according to actual needs. In other embodiments, the debris discharge port 221 also may be provided on a bottom surface of the liquid storage box 22.

In the present embodiment, by providing the debris storage box 21 with the debris collection cavity 212, and providing the liquid storage box 22 with the debris discharge port structure, further providing the debris discharge port 221 in pneumatic communication with the debris collection cavity 212, and configuring the debris discharge port 221 to discharge the debris in the debris collection cavity 212 under the vacuum negative pressure, the assembly constituted by the liquid storage box 22 and the debris storage box 21 is allowed to have multiple functions such as debris collecting, debris discharging, and liquid storing, and the user can realize use of the cleaning robot 100 in multiple scenarios (the debris collecting scenario, the debris discharging scenario, the mopping scenario, etc.), without frequently switching between the debris collecting module and the liquid storing module.

Figure 7:
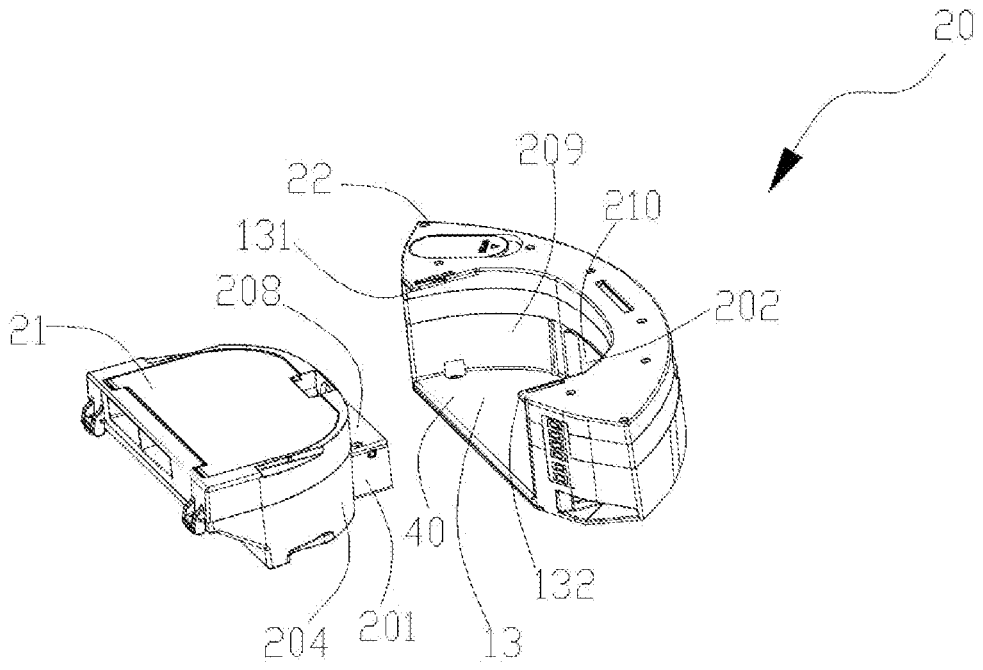
FIG. 7 is an exploded schematic view of the cleaning box assembly provided in an embodiment of the present disclosure (a debris storage box is separated from a liquid storage box)
Figure 8:
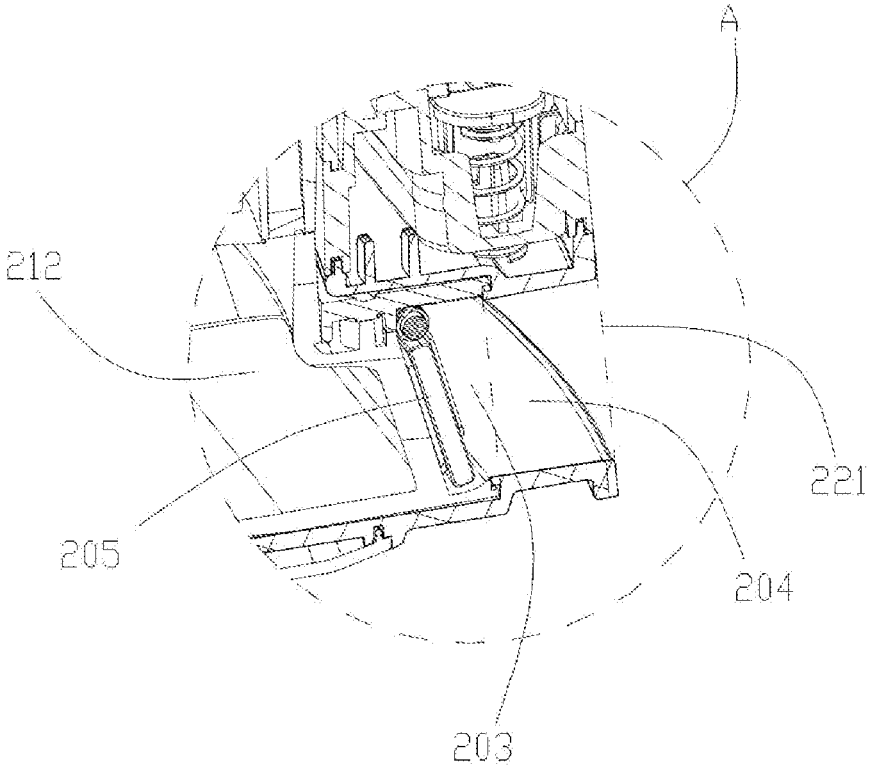
FIG. 8 is an enlarged schematic view of a part A in FIG. 5.

Referring to FIG. 5, FIG. 7, and FIG. 8, in some embodiments, the debris storage box 21 is provided with a first debris discharge portion 201, the liquid storage box 22 is provided with a second debris discharge portion 202, the second debris discharge portion 202 is provided to be butted with the first debris discharge portion 201, and a side of the second debris discharge portion 202 away from the first debris discharge portion 201 is provided with the debris discharge port 221. In the above, the first debris discharge portion 201 is butted with the second debris discharge portion 202 along with the assembling of the debris storage box 21 and the liquid storage box 22. In the above, the first debris discharge portion 201 includes a first debris discharge channel 203 communicated with the debris collection cavity 212, the second debris discharge portion 202 includes a second debris discharge channel 204 aligned with the first debris discharge channel 203, at least one of the first debris discharge channel 203 and the second debris discharge channel 204 is provided with a debris discharge valve 205, and the debris discharge valve 205 is configured to enable the debris discharge port 221 and the debris collection cavity 212 communicated in response to the vacuum negative pressure at the debris discharge port 221, and isolate the debris discharge port 221 from the debris collection cavity 212 after the vacuum negative pressure is withdrawn. In other embodiments, the debris storage box 21 is provided with a first debris discharge portion 201, the first debris discharge portion 201 is provided on a side wall of the debris storage box 21 in a protruding way, and the liquid storage box 22 is provided with a recess mating with the first debris discharge portion 201, and the debris discharge port 221 is provided in a manner of penetrating through the recess.

The connection position of the first debris discharge portion 201 and the second debris discharge portion 202 is provided with a sealing portion, and the sealing portion is provided on the first debris discharge portion 201 or the second debris discharge portion 202, so that the first debris discharge portion 201 and the second debris discharge portion 202 are connected in a sealed manner, avoiding debris leakage at the joint between the first debris discharge portion 201 and the second debris discharge portion 202.

In the above, the debris discharge valve 205 may include a plate. The plate is movably provided. The plate may be any one of a metal plate, a plastic plate, a silica gel plate, a rubber plate, or a plate of composite material, etc. When the plate is a rigid plate, for example, when the plate is a metal plate or a plastic plate, an elastic member is provided at a joint between the plate and a main body of the debris storage box 21, and the plate can automatically return to an initial position under the elastic effect of the elastic member; and when the plate is an elastic plate, for example, when the plate is a silica gel plate or a rubber plate, the plate automatically return to an initial position under its own elastic effect.

In the above, in the present embodiment, the first debris discharge channel 203 is provided therein with the debris discharge valve 205, and the second debris discharge channel 204 is not provided with the debris discharge valve 205. In other embodiments, no debris discharge valve 205 is provided in the first debris discharge channel 203, and the second debris discharge channel 204 is provided therein with the debris discharge valve 205; alternatively, the first debris discharge channel 203 and the second debris discharge channel 204 are each provided therein with the debris discharge valve 205.

Figure 9:
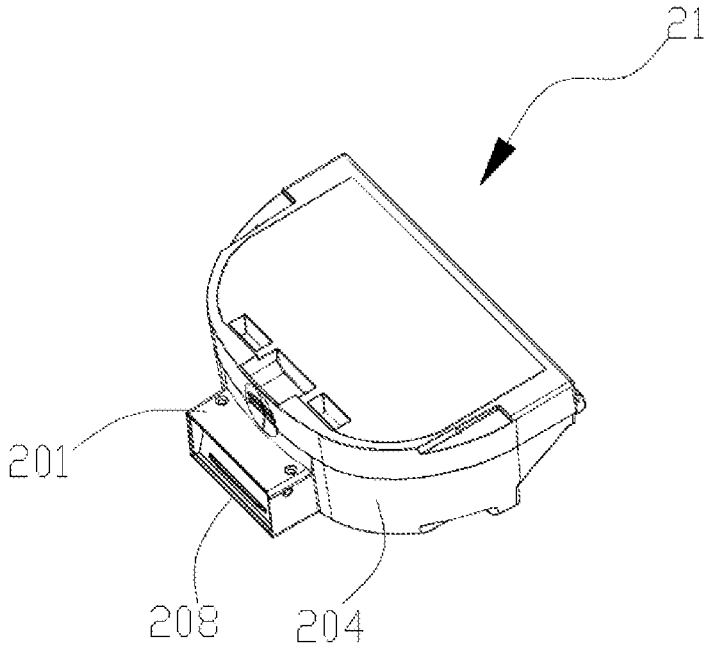
FIG. 9 is a structural schematic view of the debris storage box provided in an embodiment of the present disclosure.
Figure 10:
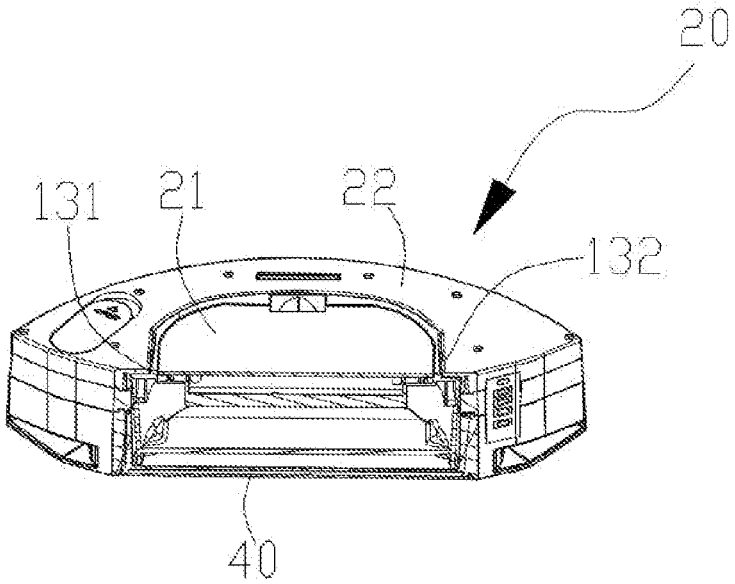
FIG. 10 is a second sectional structural schematic view of the cleaning box assembly provided in an embodiment of the present disclosure.

Referring to FIG. 7, FIG. 8, and FIG. 9, further, a side of the debris storage box 21 close to the liquid storage box 22 is provided with a first fitting surface 204 and a protruding portion 208 provided on the first fitting surface 204 in a protruding manner, a side of the liquid storage box 22 close to the debris storage box 21 is provided with a second fitting surface 209 and a butt groove 210 penetrating through the second fitting surface 209, the second fitting surface 209 is fitted with the first fitting surface 204, the protruding portion 208 is inserted into the butt groove 210, the first debris discharge channel 203 extends from an end portion of the protruding portion 208 to communicate with the debris collection cavity 212, and a part of the second debris discharge channel 204 forms the butt groove 210.

In the present embodiment, the first fitting surface 204 is arc-shaped, and the second fitting surface 209 is arc-shaped. In other embodiments, the first fitting surface 204 also may be in other shapes, and the second fitting surface 209 also may be in other shapes, which could be set by those skilled in the art according to actual needs.

In the present embodiment, the protruding portion 208 is provided in a block shape, and the shape of the butt groove 210 is adapted to the shape of the protruding portion 208. In other embodiments, the protruding portion 208 also may be of any one of a cylindrical shape, a special-shaped cylindrical shape, or an elliptic cylindrical shape, etc., and those skilled in the art could set the same on their own initiative according to actual needs.

Referring to FIG. 6 to FIG. 9, further, the robot main body 10 is configured to be detached and separated from the liquid storage box 22 along a first preset direction, the debris storage box 21 is configured to be detached and separated from the liquid storage box 22 along a second preset direction, such that the first debris discharge portion 201 is separated from the second debris discharge portion 202 along the second preset direction, wherein the first preset direction and the second preset direction both point to a side of the debris storage box 21 where the air inlet 211 is provided.

In the present embodiment, the air inlet 211 and the first debris discharge portion 201 are located at two opposite sides of the debris storage box 21, respectively. The air inlet 211 is located on a side of the debris storage box 21 facing away from the liquid storage box 22, and the first debris discharge portion 201 is located on a side of the debris storage box 21 close to the liquid storage box 22. On the one hand, as both the first preset direction and the second preset direction point to the side of the debris storage box 21 where the air inlet 211 is provided, the user can hold the liquid storage box 22 with one hand, hold the robot main body 10 with the other hand, and then apply a pulling force towards opposite directions with both hands, which can realize separation of the liquid storage box 22 from the robot main body 10, subsequently, the user continues to hold the liquid storage box 22 with one hand, and holds the debris storage box 21 with the other hand, and then continues to apply a pulling force towards opposite directions with two hands, which can realize separation of the debris storage box 21 from the liquid storage box 22. It can be seen that the above operations are simple and repetitive, and conform to operation habits of the user, thus facilitating the improvement of user experience; and on the other hand, as both the first preset direction and the second preset direction point to the side of the debris storage box 21 where the air inlet 211 is provided, the user can realize the separation of the debris storage box 21 from the liquid storage box 22 just by pushing and pulling the debris storage box 21 in the second preset direction (the side where the air inlet 211 is located). In the process of pushing and pulling in the second preset direction, the debris in the debris storage box 21 are not easy to spill and leak to the air inlet 211, which helps to avoid leakage of the debris in the debris storage box 21 at the air inlet 211 due to shaking when the debris storage box 21 is separated from the liquid storage box 22.

Referring to FIG. 6 to FIG. 10, further, the liquid storage box 22 is provided in an arc-shaped structure, such that the cleaning box assembly mounting groove 13 is formed on an interior side of the liquid storage box 22. The debris storage box 21 is detachably mounted in the cleaning box assembly mounting groove 13. A first guide portion 131 and a second guide portion 132 are respectively provided on two opposite side walls of the cleaning box assembly mounting groove 13. The first guide portion 131 and the second guide portion 132 are provided in a coplanar way. The first guide portion 131 and the second guide portion 132 are configured to guide the debris storage box 21 at two sides, so as to guide the debris storage box 21 to be detached from or assembled with the liquid storage box 22 along the second preset direction.

In the present embodiment, the robot main body 10 has the first circumferential side surface 12 and the cleaning box assembly mounting groove 13 penetrating through the first circumferential side surface 12. The debris storage box 21 and the liquid storage box 22 are detachably mounted in the cleaning box assembly mounting groove 13. The liquid storage box 22 has the second circumferential side surface 14, and the second circumferential side surface 14 is flush with the first circumferential side surface 12 to form a continuous ring shape. The debris discharge port 221 is provided in a way of penetrating through the second circumferential side surface 14. In the above, the ring shape may be a circular ring, a rectangular ring, or other shaped rings, which could be set by those skilled in the art according to actual needs.

The liquid storage box 22 is further provided with a support plate 40. The support plate 40 is connected between two ends of the liquid storage box 22, and is provided around the bottom of the cleaning box assembly mounting groove 13. A plane where the first guide portion 131 and the second guide portion 132 are located is spaced apart from the support plate 40 in a height direction of the liquid storage box 22. When the debris storage box 21 is mounted in the cleaning box assembly mounting groove 13, the first guide portion 131, the second guide portion 132, and the support plate 40 are configured to limit both upper and lower sides of the debris storage box 21, so that the debris storage box 21 cannot be separated from the liquid storage box 22 in an up-down direction, and the debris storage box 21 is kept fixed relative to the liquid storage box 22 in the up-down direction. Moreover, when the debris storage box 21 is separated from the liquid storage box 22, the first guide portion 131, the second guide portion 132, and the support plate 40 may function to guide the debris storage box 21, and lead the debris storage box 21 to move towards the second preset direction.

In the above, the first guide portion 131 and the second guide portion 132 are both provided adjacent to a top side of the liquid storage box 22; alternatively, both the first guide portion 131 and the second guide portion 132 are provided adjacent to a bottom side of the debris storage box 21; alternatively, the first guide portion 131 and the second guide portion 132 are located between the top side and the bottom side of the debris storage box 21.

Specific structural forms of the first guide portion 131 and the second guide portion 132 may be varied, for example, a baffle structure, a rib structure, or a guide block structure, which is not limited herein.

Figure 11:
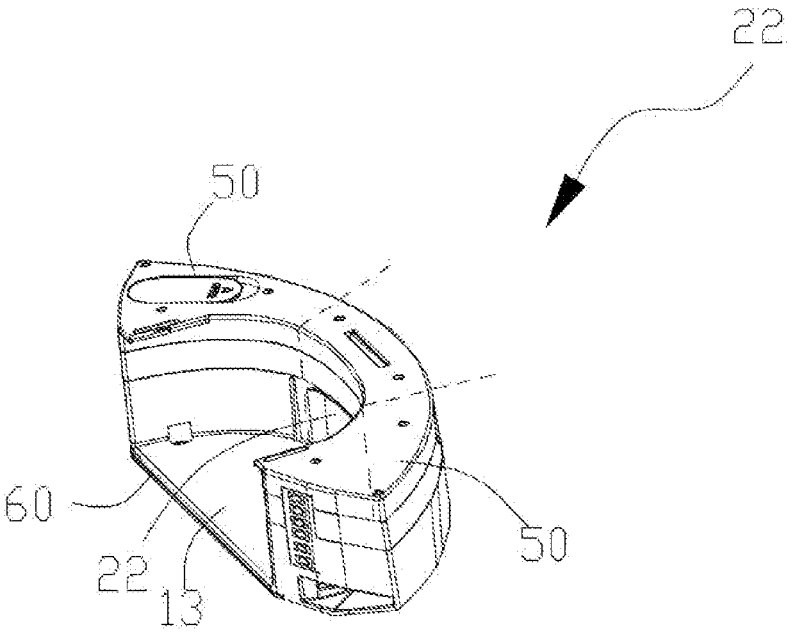
FIG. 11 is a structural schematic view of the liquid storage box provided in an embodiment of the present disclosure.
Figure 12:
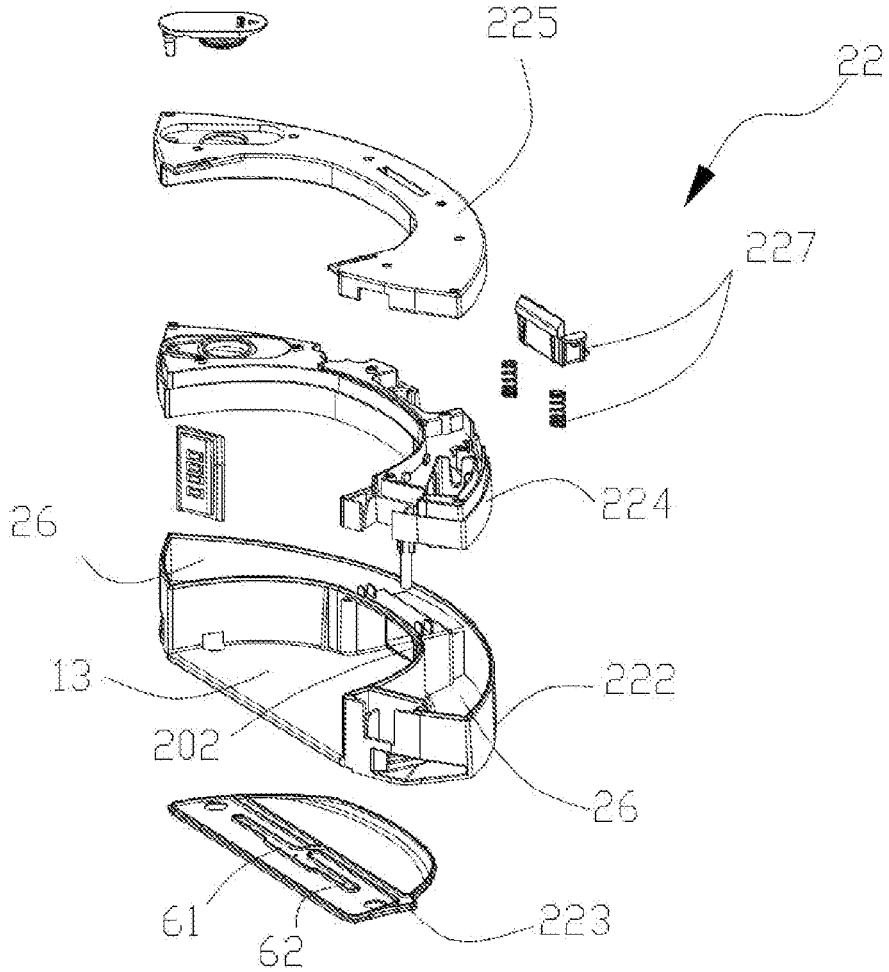
FIG. 12 is an exploded view of the liquid storage box provided in an embodiment of the present disclosure.

Referring to FIG. 7, FIG. 11, and FIG. 12, further, the liquid storage box 22 includes two liquid storage portions 50 provided opposite to each other, the second debris discharge portion 202 is connected between the two liquid storage portions 50, the second debris discharge portion 202 and the two liquid storage portions 50 are arranged in an arc shape, so that the cleaning box assembly mounting groove 13 is formed on an interior side of the liquid storage box 22, and the debris storage box 21 is detachably mounted in the cleaning box assembly mounting groove 13.

In the present embodiment, each of the liquid storage portions 50 is provided therein with a liquid storage cavity, and the liquid storage cavity is configured to store clear water, a cleaning solution or a mixture of clear water and the cleaning solution. As the second debris discharge portion 202 and the two liquid storage portions 50 are arranged in an arc shape, and the three are arranged compactly, there is enough space inside the liquid storage box 22 to form the cleaning box assembly mounting groove 13, facilitating the installation of the debris storage box 21 with a relatively large volume.

In the present embodiment, the second debris discharge portion 202 occupies a space between the two liquid storage portions 50 in a horizontal direction. The second debris discharge portion 202 separates the two liquid storage portions 50 from each other. The second debris discharge portion 202 inhibits liquid flow between the two liquid storage portions 50. The second debris discharge portion 202 separates the two liquid storage portions 50 from each other. The liquid storage box 22 further includes a water supply portion 60. The water supply portion 60 is provided at the bottom of the liquid storage box 22. The water supply portion 60 connects the two liquid storage portions 50. The water supply portion 60 is provided with a water supply flow path 61 and at least one water supply hole 62 in communication with the water supply flow path 61. The water supply flow path 61 is in communication with the two liquid storage portions 50. The liquid in the two liquid storage portions 50 flows from the water supply flow path 61 to the at least one water supply hole 62, for wetting the mopping and wiping assembly.

In the above, the water supply portion 60 is flat, so as to decrease the thickness of the water supply portion 60, and reduce the volume occupied by the water supply portion 60, being beneficial to the miniaturization of the liquid storage box. The at least one water supply hole 62 is provided at a side of the water supply portion 60 away from the cleaning box assembly mounting groove 13, that is, the at least one water supply hole 62 is provided at the bottom of the liquid supply box. The number of water supply holes 62 may be one, two, three, or more than three. As the water supply portion 60 is directly provided at the bottom of the liquid storage box 22, and the water supply flow path 61 of the water supply portion 60 is in communication with the two liquid storage portions 50, the two liquid storage portions 50 can be guided to flow from two sides of the liquid storage box 22 to the bottom of the liquid storage box 22, and further flow to the at least one water supply hole 62 through the water supply flow path 61. The above configuration overcomes the defect that, due to the configuration of the second debris discharge portion 202 in the middle, the liquid storage box 22 is provided with the liquid storage portion 50 at two sides, respectively, such that a shower-like structure is formed at the bottom of the liquid storage box 22, and water can be directly supplied to the mopping and wiping assembly, thus improving the structural compactness and the space utilization rate of the liquid storage box 22, and being beneficial to save the space.

In the present embodiment, the liquid storage box 22 includes a middle shell 222, a bottom shell 223, a cover plate 224, and a top cover 225. The middle shell 222 is provided with two liquid storage cavities 26 provided opposite to each other and the second debris discharge portion 202 located between the two liquid storage cavities. The two liquid storage cavities 26 and the second debris discharge portion 202 are arranged in an arc shape. The middle shell 222 is recessed to form at least a part of the cleaning box assembly mounting groove 13. The two liquid storage cavities 26 each have a cavity opening which is open to the outside, and the cavity openings of the two liquid storage cavities 26 both face a top side of the middle shell 222. The bottom shell 223 covers a bottom side of the middle shell 222. The bottom shell 223 and the middle shell 222 are enclosed to form the water supply flow path 61. The bottom shell 223 is provided with the at least one water supply hole 62. A part of the bottom shell 223 corresponding to the cleaning box assembly mounting groove 13 and a part of the middle shell 222 corresponding to the cleaning box assembly mounting groove 13 form the water supply portion 60. The cover plate 224 covers a side of the middle shell 222 away from the bottom shell 223, and the cover plate 224 may function to seal and cover the two liquid storage cavities 26. The top cover 225 covers one side of the cover plate 224 away from the middle shell 222. An accommodating cavity is formed between the top cover 225 and the cover plate 224, and the accommodating cavity is configured to at least partially accommodate any one or a combination of more than one of an air pump, a water pump, a pipeline, a cable, charging contacts, etc. Parts of the liquid storage box 22 corresponding to the two liquid storage cavities 26 form the two liquid storage portions 50, respectively.

Referring to FIG. 6 and FIG. 12, further, the liquid storage box 22 further includes a fastening mechanism 227, the fastening mechanism 227 is connected between the two liquid storage portions 50, the fastening mechanism 227 and the second debris discharge portion 202 are provided in a stacking manner in the height direction of the liquid storage box 22, and the liquid storage box 22 is fastened on the robot main body 10 through the fastening mechanism 227. By means of the above arrangement, orthographic projections of the fastening mechanism 227 and the second debris discharge portion 202 on the lowest horizontal plane of the liquid storage box 22 coincide with each other, so that the fastening mechanism 227 can be prevented from occupying a water storage space of the liquid storage box 22, thus facilitating the realization of a compact structure of the liquid storage box 22 and improving the water storage volume.

In the present embodiment, the fastening mechanism 227 includes a fastening portion and an operating portion connected to the fastening portion, and a spring, wherein the fastening portion is telescopically provided on a top surface of the liquid storage box 22, the operating portion is rotatably connected or slidably connected to a shell of the liquid storage box 22, the spring elastically connects the operating portion and the shell of the liquid storage box 22, and the spring provides an elastic force for returning the operating portion and the fastening portion to initial positions. The fastening portion is provided to protrude from the top surface of the liquid storage box 22 at the initial position, so that the liquid storage box 22 can be fastened on the robot main body 10 through the fastening portion. When operating the operating portion, the user can drive the fastening portion to move relative to the top surface of the liquid storage box 22 to a retracted position, thus it is convenient to disassemble and separate the liquid storage box 22 from the robot main body 10.

The above-mentioned are merely for preferred embodiments of the present disclosure, rather than being intended to limit the present disclosure, and any amendment, equivalent substitution, improvement and so on, made within the spirit and principle of the present disclosure, should be covered within the scope of protection of the present disclosure.

What is claimed is:

1. A cleaning robot, wherein the cleaning robot comprises a robot main body and a cleaning box assembly, wherein the robot main body comprises a debris inlet channel, wherein the cleaning box assembly is detachably mounted at one side of the robot main body, wherein the cleaning box assembly comprises a debris storage box and a liquid storage box, wherein the debris inlet channel, the debris storage box, and the liquid storage box are sequentially arranged along an advancing direction of the robot main body, wherein the debris storage box comprises an air inlet and a debris collection cavity, wherein the air inlet is operative to be butted with the debris inlet channel, wherein the debris collection cavity is disposed to be in communication with the debris inlet channel via the air inlet, wherein the liquid storage box comprises a debris discharge port, which is disposed to be in pneumatic communication with the debris collection cavity, and wherein the debris discharge port is configured to evacuate debris in the debris collection cavity under a vacuum negative pressure, wherein the debris storage box comprises a first debris discharge portion, wherein the liquid storage box comprises a second debris discharge portion, with the debris discharge port defined in a side of the second debris discharge portion facing away from the first debris discharge portion wherein the robot main body is movable and accordingly operative to be detached and separated from the liquid storage box along a first preset direction when the cleaning robot is horizontally placed, wherein the debris storage box is movable and accordingly operative to be detached and separated from the liquid storage box along a second preset direction when the cleaning robot is horizontally placed so that the first debris discharge portion is operative to be separated from the second debris discharge portion along the second preset direction, wherein the first preset direction and the second preset direction are each a horizontal direction pointing to a side of the debris storage box where the air inlet is disposed, the horizontal direction being substantially perpendicular to a height direction of the robot main body, wherein the liquid storage box is disposed to have an arc-shaped structure, thus defining a cleaning box assembly mounting groove in an interior side of the liquid storage box, wherein the debris storage box is detachably mounted in the cleaning box assembly mounting groove, wherein a first guide portion and a second guide portion are respective planar extensions of two opposite side walls of the cleaning box assembly mounting groove at a top surface of the liquid storage box to fit into corresponding notches in the debris storage box, the first guide portion and the second guide portion are coplanar and are positioned to be vertically opposite to and parallel to a flat support plate of the liquid storage box, wherein the first guide portion and the second guide portion are configured to guide the debris storage box at two respective sides so as to guide the debris storage box to be detached from or assembled with the liquid storage box along the second preset direction, wherein the flat support plate is connected between two ends of the liquid storage box, and is provided disposed around a bottom of the cleaning box assembly mounting groove, such that the flat support plate forms a flat bottom surface that extends into the second debris discharge portion, wherein a plane wherein a plane in which the first guide portion and the second guide portion are located is spaced apart from the support plate in a height direction of the liquid storage box, and wherein when the debris storage box is mounted in the cleaning box assembly mounting groove, the first guide portion, the second guide portion, and the support plate are operative to limit both upper and lower sides of the debris storage box so that the debris storage box is not operative to be separated from the liquid storage box in an up-down vertical direction substantially parallel with the height direction of the liquid storage box; wherein the height direction of the robot main body is substantially parallel with the height direction of the liquid storage box, the up-down vertical direction substantially perpendicular to a plane that forms the flat bottom surface of the flat support plate; wherein the second debris discharge portion is operative to be butted with the first debris discharge portion such that the first debris direction is inserted into the second debris portion in the horizontal direction.

2. The cleaning robot according to claim 1, wherein the first debris discharge portion comprises a first debris discharge channel communicated with the debris collection cavity, the second debris discharge portion comprises a second debris discharge channel butted with the first debris discharge channel, both of the first debris discharge channel and the second debris discharge channel are provided with a debris discharge valve, or either of the first debris discharge channel or the second debris discharge channel is provided with a debris discharge valve, and the debris discharge valve is configured to make the debris discharge port and the debris collection cavity communicated in response to vacuum negative pressure at the debris discharge port, and isolate the debris discharge port from the debris collection cavity after the vacuum negative pressure is removed.

3. The cleaning robot according to claim 2, wherein a side of the debris storage box close to the liquid storage box is provided with a first fitting surface and a protruding portion provided on the first fitting surface in a protruding manner, a side of the liquid storage box close to the debris storage box is provided with a second fitting surface and a butt groove penetrating through the second fitting surface, the second fitting surface is fitted with the first fitting surface, the protruding portion is inserted into the butt groove, the first debris discharge channel extends from an end portion of the protruding portion to communicate with the debris collection cavity, and a part of the second debris discharge channel forms the butt groove.

4. The cleaning robot according to claim 2, wherein when either of the first debris discharge channel or the second debris discharge channel is provided with the debris discharge valve, the first debris discharge channel is provided therein with the debris discharge valve.

5. The cleaning robot according to claim 1, wherein the liquid storage box comprises two liquid storage portions provided opposite to each other, the second debris discharge portion is connected between the two liquid storage portions, the second debris discharge portion and the two liquid storage portions are arranged in an arc shape, so that the cleaning box assembly mounting groove is formed on the interior side of the liquid storage box, and the debris storage box is detachably mounted in the cleaning box assembly mounting groove.

6. The cleaning robot according to claim 5, wherein the second debris discharge portion separates the two liquid storage portions from each other, the liquid storage box further comprises a water supply portion, the water supply portion is provided at a bottom of the liquid storage box, the water supply portion connects the two liquid storage portions, the water supply portion is provided with a water supply flow path and at least one water supply hole in communication with the water supply flow path, the water supply flow path is in communication with the two liquid storage portions, and a liquid in the two liquid storage portions flows from the water supply flow path to the at least one water supply hole, for wetting a mopping and wiping assembly.

7. The cleaning robot according to claim 6, wherein the water supply portion is flat, so as to decrease a thickness of the water supply portion, and reduce a volume occupied by the water supply portion, and the at least one water supply hole is provided at a side of the water supply portion away from the cleaning box assembly mounting groove.

8. The cleaning robot according to claim 5, wherein the liquid storage box further comprises a fastening mechanism, the fastening mechanism is connected between the two liquid storage portions, the fastening mechanism and the second debris discharge portion are provided in a stacking manner in a height direction of the liquid storage box, and the liquid storage box is fastened on the robot main body through the fastening mechanism.

9. The cleaning robot according to claim 1, wherein the robot main body has a first circumferential side surface and a robot main body mounting groove penetrating through the first circumferential side surface, the debris storage box and the liquid storage box are detachably mounted in the robot main body mounting groove penetrating through the first circumferential side surface, the liquid storage box has a second circumferential side surface, the second circumferential side surface is flush with the first circumferential side surface to form a continuous ring shape, and the debris discharge port is provided in a way of penetrating through the second circumferential side surface.

10. The cleaning robot according to claim 1, wherein the debris discharge port is provided on a bottom surface of the liquid storage box.

11. The cleaning robot according to claim 1, wherein the liquid storage box comprises a middle shell, a bottom shell, a cover plate, and a top cover, wherein the middle shell is provided with two liquid storage cavities provided opposite to each other and the second debris discharge portion located between the two liquid storage cavities, wherein the two liquid storage cavities and the second debris discharge portion are arranged in an arc shape, the middle shell is recessed to form at least a part of the cleaning box assembly mounting groove, the two liquid storage cavities each have a cavity opening which is open to the outside, and the cavity openings of the two liquid storage cavities both face a top side of the middle shell, the bottom shell covers a bottom side of the middle shell, the bottom shell and the middle shell are enclosed to form a water supply flow path, the bottom shell is provided with at least one water supply hole, wherein a part of the bottom shell corresponding to the cleaning box assembly mounting groove and a part of the middle shell corresponding to the cleaning box assembly mounting groove form a water supply portion, the cover plate covers a side of the middle shell away from the bottom shell, and the cover plate is configured to seal and cover the two liquid storage cavities, and the top cover covers one side of the cover plate away from the middle shell.

12. A robot system, wherein the robot system comprises the cleaning robot according to claim 1 and a debris collection base station, the debris collection base station is provided with a debris collection port, and the debris discharge port of the cleaning robot is configured to be aligned with the debris collection port so as to allow the debris collection base station to collect the debris from the debris collection cavity under the vacuum negative pressure.

* * * * *